US011635781B2

(12) United States Patent
Liu

(10) Patent No.: US 11,635,781 B2
(45) Date of Patent: Apr. 25, 2023

(54) QUICK-RELEASE STRUCTURE CAPABLE OF STORING ROTATING HANDLE

(71) Applicant: FUL CHEE ENT CO., LTD., Taichung (TW)

(72) Inventor: Yu-Chen Liu, Taichung (TW)

(73) Assignee: FUL CHEE ENT CO., LTD., Taichung (TW)

( * ) Notice: Subject to any disclaimer, the term of this patent is extended or adjusted under 35 U.S.C. 154(b) by 393 days.

(21) Appl. No.: 16/985,186

(22) Filed: Aug. 4, 2020

(65) Prior Publication Data

US 2021/0191446 A1 Jun. 24, 2021

(51) Int. Cl.

| | |
|---|---|
| ***G05G 1/08*** | (2006.01) |
| ***G05G 5/00*** | (2006.01) |
| ***B25G 1/00*** | (2006.01) |
| ***B25B 23/00*** | (2006.01) |
| ***B25G 1/08*** | (2006.01) |

(52) U.S. Cl.

CPC ..... *G05G 1/085* (2013.01); *B25B 23/0007* (2013.01); *B25G 1/007* (2013.01); *B25G 1/085* (2013.01); *G05G 5/005* (2013.01)

(58) Field of Classification Search

CPC ..... G05G 1/085; G05G 1/087; G05G 5/005; B25G 1/007; B25G 1/085; B25G 1/08; B25B 23/0007; B62K 2025/025; B62K 2025/2206; B60B 27/026; B62J 11/22

See application file for complete search history.

(56) References Cited

U.S. PATENT DOCUMENTS

| | | | | |
|---|---|---|---|---|
| 4,096,898 | A * | 6/1978 | Messerly | B29D 30/0685 585/12 |
| 9,963,190 | B1 * | 5/2018 | Liu | F16B 7/0426 |
| 2002/0002744 | A1 * | 1/2002 | Levia | B25G 1/08 7/100 |
| 2018/0361787 | A1 * | 12/2018 | Chang | B62K 25/02 |

* cited by examiner

*Primary Examiner* — Daniel D Yabut

(74) *Attorney, Agent, or Firm* — Che-Yang Chen; Law Office of Michael Chen

(57) ABSTRACT

A quick-release structure includes a shaft and a driving assembly. Two ends of the shaft have a receiving hole and a connecting hole, respectively. The driving assembly includes a rotating handle and a connecting rod. One end of the rotating handle is provided with an end cap. The connecting rod includes a pivoting end and a driving section. The rotating handle is pivotally connected to the pivoting end of the connecting rod so that the rotating handle can be pivoted relative to one side of the connecting rod. When in use, the driving section is engaged in the connecting hole, and the rotating handle can be turned to drive the shaft to rotate; when not in use, the driving assembly is inserted into the receiving hole, and the end cap is pressed against an outer end of the receiving hole to be positioned.

10 Claims, 5 Drawing Sheets

QUICK-RELEASE STRUCTURE CAPABLE OF STORING ROTATING HANDLE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a quick-release structure capable of storing a rotating handle. When not in use, the rotating handle can be stored and hidden in a receiving hole of the quick-release structure, thereby preventing the situation that the user forgets the storage location of the rotating handle or losing the rotating handle accidentally.

Description of Related Arts

A conventional quick-release structure is used for connecting a fork by inserting the quick-release structure through a wheel hub. As shown in FIGS. 1 to 3, the quick-release structure comprises a shaft 10, a rotating handle 14, and a connecting shaft 16. The shaft 10 has a through hole 101 extending along its axial direction. The outer circumferential surface of one end of the shaft 10 has a threaded section 11 to be screwed with a fork, and the other end of the shaft 10 has a round shaft head 12 for pressing against another fork. The outer end of the round shaft head 12 is formed with a connecting hole 13 having a predetermined shape. The connecting hole 13 is recessed along the axial direction of the shaft 10. The connecting hole 13 communicates with the through hole 101. The inner diameter of the connecting hole 13 is greater than the inner diameter of through hole 101. The rotating handle 14 is formed with an engaging hole 15 having a predetermined shape. Two ends of the connecting shaft 16 are provided with a connecting section 17 and a positioning section 18, respectively. The outer diameter of the connecting section 17 is greater than the outer diameter of the positioning section 18. The outer diameter of the connecting section 17 has a polygonal shape. The connecting hole 13 and the engaging hole 15 are formed into a polygonal shape corresponding to the connecting section 17. The positioning section 18 is cylindrical. The positioning section 18 is formed with two annular grooves 181. Each annular groove 181 is sleeved with a washer 19. The outer end of the connecting section 17 having a predetermined length is inserted and engaged with the engaging hole 15 to be connected together, and then the positioning section 18 of the connecting shaft 16 is inserted into the connecting hole 13 and the through hole 101. The positioning section 18 is elastically forced into the through hole 101 through the washer 19. The inner end of the connecting section 17 and the connecting hole 13 are connected with each other and locked together, so that the rotating handle 14 is rotated forward or reversely to drive the connecting shaft 16 and the shaft 10 to rotate synchronously, that is, the threaded section 11 of the shaft 10 can be screwed to or unscrewed from the fork. When the rotating handle 14 is not in use, the rotating handle 14 and the connecting shaft 16 can be separated from the connecting hole 13 to separate the rotating handle 14 from the shaft 10. This can avoid accidentally touching the rotating handle 14 to loosen the shaft 10. However, after the rotating handle 14 is separated from the shaft 10, the rotating handle 14 is stored separately. After a long time, the user may forget the position of the rotating handle 14 or even lose the rotating handle 14 accidentally. Accordingly, the inventor of the present invention has devoted himself based on his many years of practical experiences to solve these problems.

SUMMARY OF THE PRESENT INVENTION

The primary object of the present invention is to provide a quick-release structure capable of storing a rotating handle, comprising a shaft and a driving assembly. Two ends of the shaft have a receiving hole and a connecting hole, respectively. The driving assembly includes a rotating handle and a connecting rod. The rotating handle is pivotally connected to the connecting rod. When in use, the connecting rod is inserted into the connecting hole, and the shaft is pivoted by the rotating handle. When not in use, the rotating handle is hidden in the receiving hole so that it can be stored and not exposed.

In order to achieve the above object, a quick-release structure comprises a shaft and a driving assembly. An outer circumferential surface of one end of the shaft has a first threaded section, and another end of the shaft has a round shaft head. An outer end of the first threaded section is formed with a receiving hole that is recessed inwardly. The driving assembly includes a rotating handle and a connecting rod. The rotating handle is pivotally connected to the connecting rod. The rotating handle is in the form of a rod. One end of the rotating handle is provided with an end cap. Another end of the rotating handle has a connecting end. A first O-ring is sleeved on the rotating handle. The connecting rod is in the form of a rod. The connecting rod includes a pivoting end and a driving section that are arranged in sequence from one end thereof. A second O-ring is provided between the pivoting end and the driving section. The connecting end of the rotating handle is pivotally connected to the pivoting end of the connecting rod so that the rotating handle can be pivoted relative to one side of the connecting rod. The driving section has a shape corresponding to that of the connecting hole of the shaft. When in use, the driving section is engaged in the connecting hole, and the rotating handle can be turned to drive the shaft to rotate; when not in use, the driving assembly is inserted into the receiving hole, the first O-ring and the second O-ring are against an inner circumferential surface of the receiving hole, and the end cap is pressed against an outer end of the receiving hole to be positioned.

In an embodiment of the present invention, the connecting end has a lateral through hole. The pivoting end has a pivoting slot and a lateral perforation communicating with the pivoting slot. The connecting end of the rotating handle is assembled to the pivoting slot of the connecting rod, and an axle is inserted through the lateral through hole and the lateral perforation to connect the rotating handle and the connecting rod.

In an embodiment of the present invention, one side of the pivoting slot is provided with a stop wall.

In an embodiment of the present invention, the rotating handle is able to pivot 90 degrees relative to the side of the connecting rod.

In an embodiment of the present invention, the driving section is a polygonal rod, and the connecting hole is a polygonal hole.

In an embodiment of the present invention, a first annular groove is formed on the rotating handle. The first O-ring is sleeved on the first annular ring groove. A second annular groove is provided between the pivoting end and the driving section. The second O-ring is sleeved on the second annular groove.

In an embodiment of the present invention, the first annular groove is close to the end cap.

In an embodiment of the present invention, the driving section has an outer diameter less than that of the pivoting end so that one end of the pivoting end forms an annular stop edge facing the driving section. The annular stop edge is configured to lean against an outer end of the connecting hole when the driving section is engaged in the connecting hole.

In an embodiment of the present invention, the shaft has an inner hole extending from the connecting hole. The connecting rod further includes a tool head extending from the driving section. The tool head is located in the inner hole.

In an embodiment of the present invention, the tool head has an outer diameter less than that of the driving section.

With the above structure, when not in use, the rotating handle can be stored and hidden in the quick-release structure, thereby preventing the situation that the user forgets the storage location of the rotating handle or losing the rotating handle accidentally.

DETAILED DESCRIPTION OF THE PREFERRED EMBODIMENT

Figure 1:
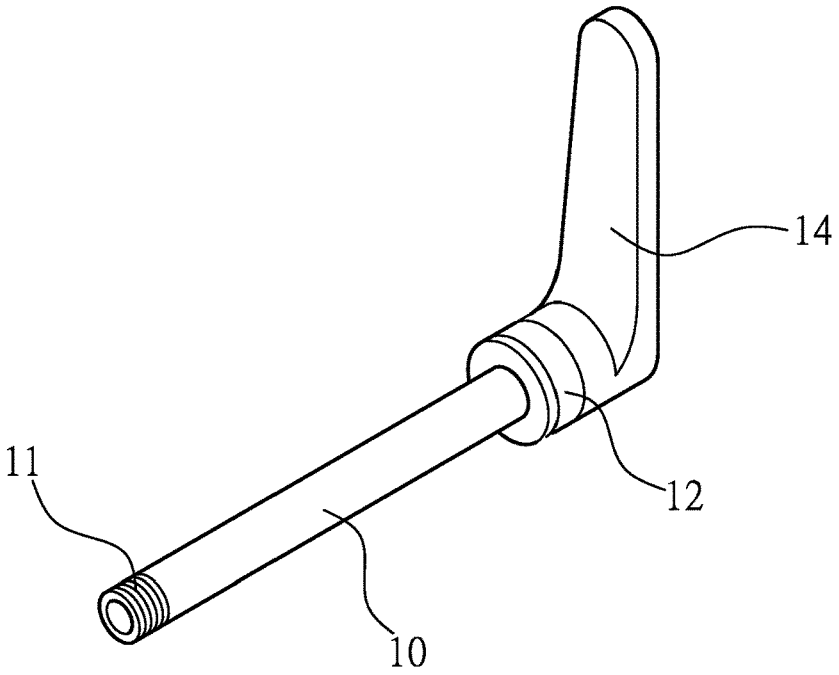
PRIOR ART FIG.1
FIG. 1 is a perspective view of a conventional quick-release structure.
Figure 2:
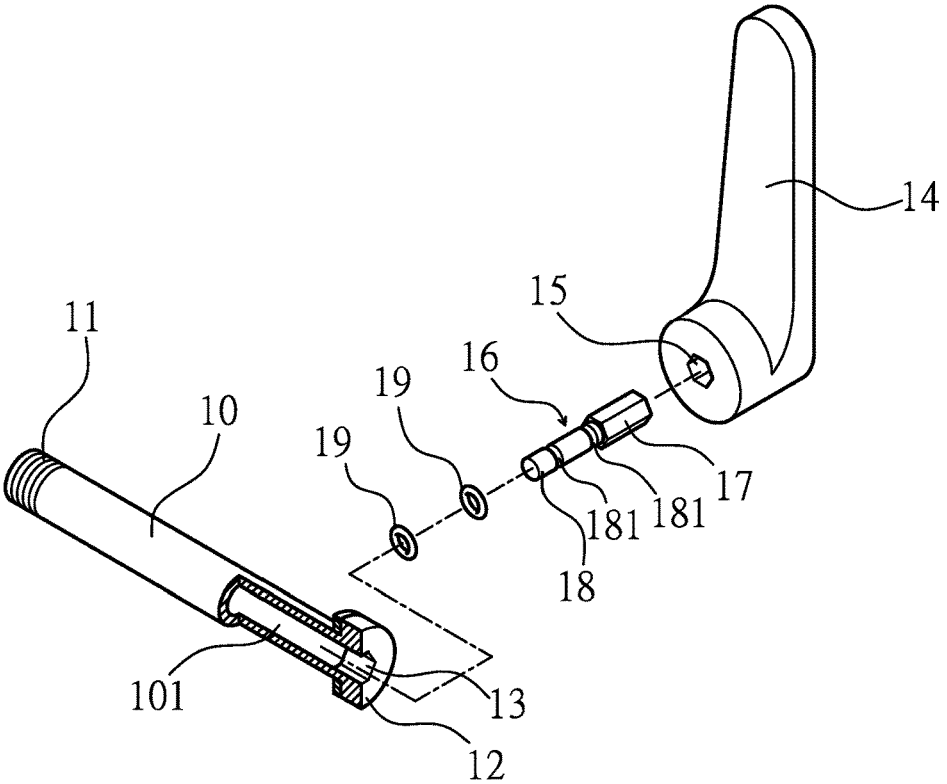
PRIOR ART FIG.2
FIG. 2 is an exploded view of the conventional quick-release structure.
Figure 3:
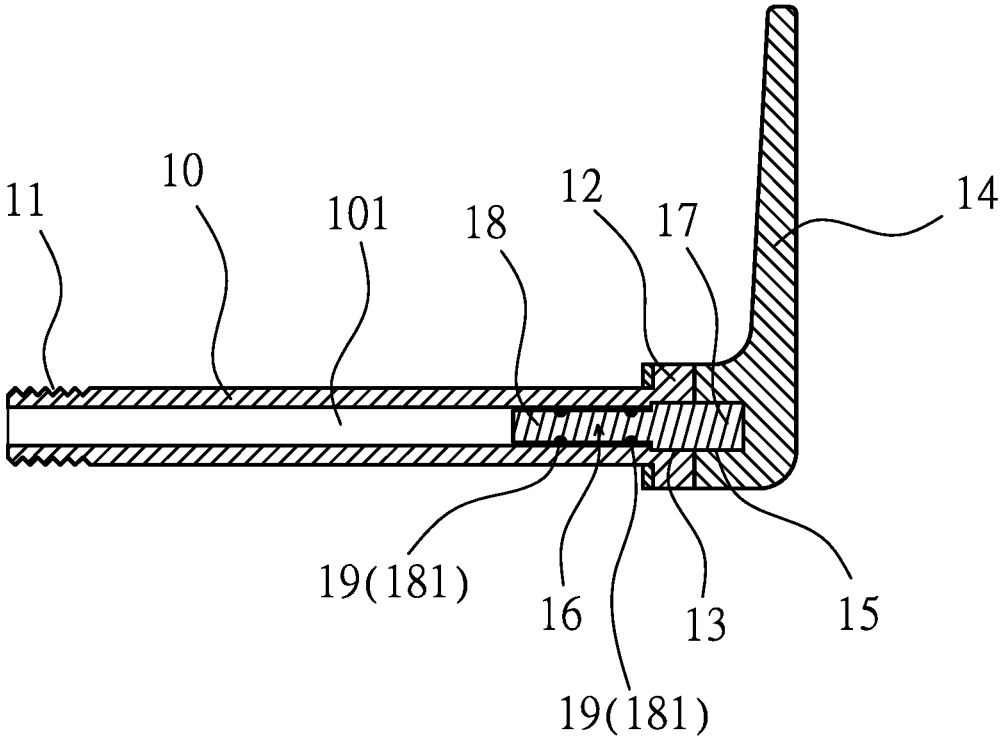
PRIOR ART FIG.3
FIG. 3 is a cross-sectional view of the conventional quick-release structure.
Figure 4:
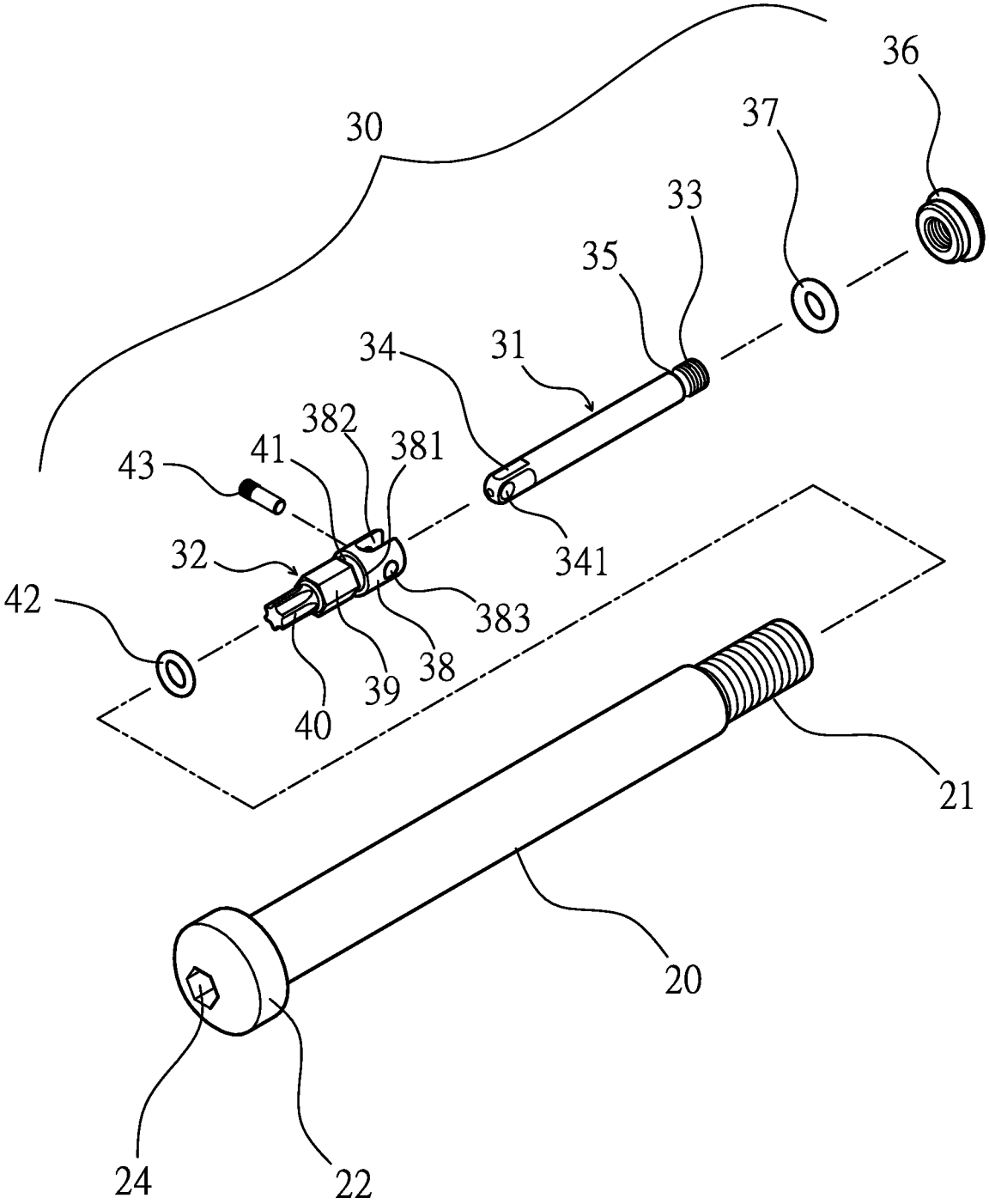
FIG. 4 is an exploded view of the present invention.

Embodiments of the present invention will now be described, by way of example only, with reference to the accompanying drawings.

Referring to FIGS. 4 to 7, a quick-release structure capable of storing a rotating handle, comprising a shaft 20 and a driving assembly 30. The outer circumferential surface of one end of the shaft 20 has a first threaded section 21. The other end of the shaft 20 has a round shaft head 22. The outer end of the first threaded section 21 is formed with a receiving hole 23 that is recessed inwardly along the axial direction of the shaft 20. The outer end of the round shaft head 22 is formed with a connecting hole 24 having a predetermined shape. The connecting hole 24 is recessed inwardly along the axial direction of the shaft 20. The shaft 20 has an inner hole 25 extending from the connecting hole 24.

The driving assembly 30 includes a rotating handle 31 and a connecting rod 32. The rotating handle 31 is pivotally connected to the connecting rod 32. The rotating handle 31 is in the form of a rod. The outer circumferential surface of one end of the rotating handle 31 has a second threaded section 33. The other end of the rotating handle 31 has a connecting end 34. The outer circumferential surface of the rotating handle 31 is formed with a first annular groove 35 adjacent to the second threaded section 33. An end cap 36 is screwed to the second threaded section 33. A first O-ring 37 is sleeved on the first annular ring groove 35. The connecting rod 32 is in the form of a rod. The connecting rod 32 includes a pivoting end 38, a driving section 39, and a tool head 40 that are arranged in sequence along the axial direction of the connecting rod 32 from one end thereof. A second annular groove 41 is formed between the pivoting end 38 and the driving section 39. A second O-ring 42 is sleeved on the second annular groove 41. The connecting end 34 of the rotating handle 31 is pivotally connected to the pivoting end 38 of the connecting rod 32, so that the rotating handle 31 can pivot at least 90 degrees relative to one side of the connecting rod 32. The outer diameter of the driving section 39 is less than the outer diameter of the pivoting end 38, so that one end of the pivoting end 38 forms an annular stop edge 381 facing the driving section 39. The shape of the driving section 39 corresponds to the shape of the connecting hole 24 of the shaft 20, so that the tool head 40 and the driving section 39 of the connecting rod 32 can pass through the connecting hole 24 when in use. The outer diameter of the tool head 40 is less than the outer diameter of the driving section 39. When in use, the tool head 40 can easily pass through the connecting hole 24, the annular stop edge 381 is positioned against the outer end of the connecting hole 24 when in use, the tool head 40 is located in the inner hole 25, the driving section 39 is engaged in the connecting hole 24, and the rotating handle 31 can be turned to drive the shaft 20 to rotate. When not in use, the driving assembly 30 can be inserted into the receiving hole 23, the first O-ring 37 and the second O-ring 42 are against the inner circumferential surface of the receiving hole 23, and the end cap 36 leans against the outer end of the receiving hole 23 to be positioned, so that the rotating handle 31 is stored and positioned in the receiving hole 23. With the above structure, when not in use, the rotating handle can be stored and hidden in the quick-release structure, thereby preventing the situation that the user forgets the storage location of the rotating handle or losing the rotating handle accidentally.

Figure 5:
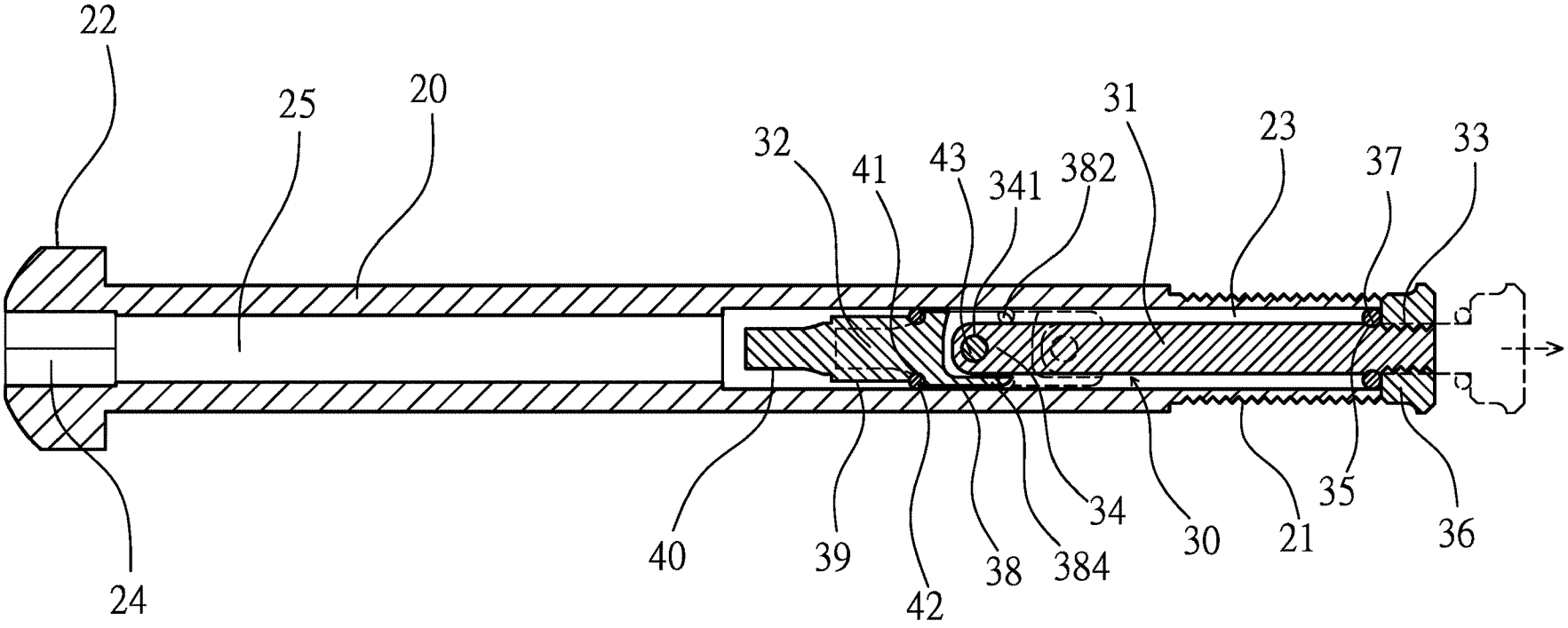
FIG. 5 is a cross-sectional view of the present invention, wherein the rotating handle is stored in the receiving hole.
Figure 6:
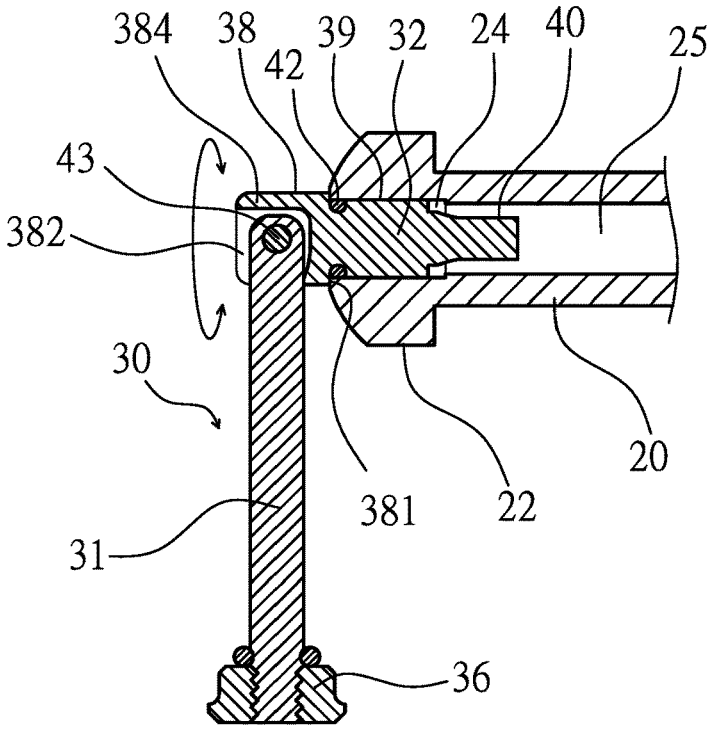
FIG. 6 is a cross-sectional view of the present invention, wherein the shaft is driven to rotate.
Figure 7:
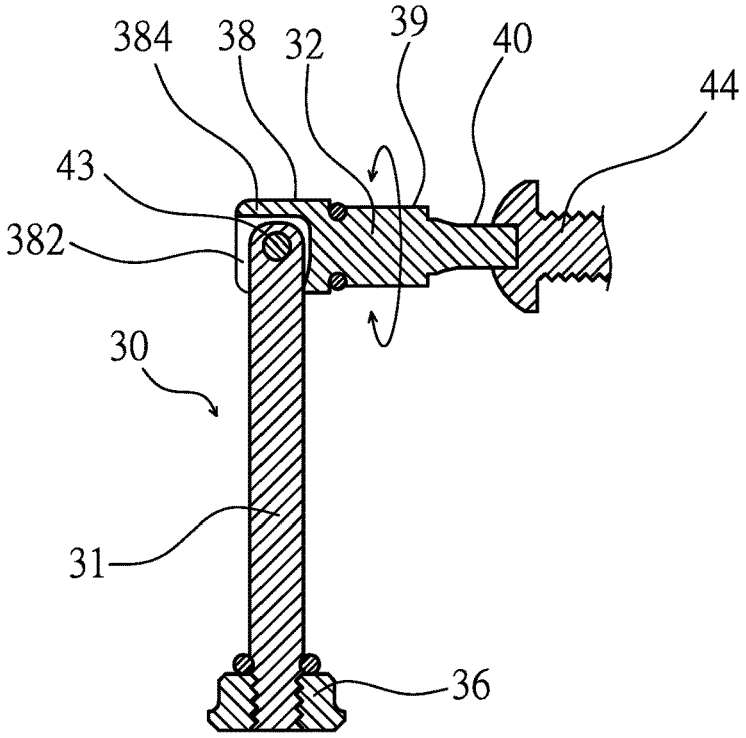
FIG. 7 is a cross-sectional view of the present invention, wherein the tool head is used for screwing a part.

The assembly and function of the present invention are described in detail as follows. As shown in FIGS. 4 to 7, in the present invention, the rotating handle 31 can be hidden in the receiving hole 23 when not in use. As to the pivoting manner of the rotating handle 31 and the connecting rod 32, preferably, the connecting end 34 has a lateral through hole 341, and the pivoting end 38 has a pivoting slot 382 and a lateral perforation 383 communicating with the pivoting slot 382. One side of the pivoting slot 382 is provided with a stop wall 384. The connecting end 34 of the rotating handle 31 is assembled to the pivoting slot 382 of the connecting rod 32, and an axle 43 is inserted through the lateral through hole 341 and the lateral perforation 383 for connecting the rotating handle 31 and the connecting rod 32, but not limited thereto. As to the shape of the driving section 39 and the connecting hole 24, preferably, the driving section 39 is a polygonal rod, and the connecting hole 24 is a polygonal hole, but not limited thereto. When the rotating handle 31 is not used, the end having the tool head 40 of the driving assembly 30 is first inserted into the receiving hole 23, the end cap 36 for easy gripping is applied with a force, the first O-ring 37 and the second O-ring 42 are respectively compressed and elastically deformed into the receiving hole 23 to generate friction (as shown in FIG. 5), and finally the end cap 36 is pressed against the outer end of the receiving hole 23, such that the rotating handle 31 is stably stored in the receiving hole 23. When the rotating handle 31 needs to be used, the driving assembly 30 can be pulled out of the receiving hole 23 through the end cap 36. Then, the end having the tool head 40 of the driving assembly 30 is inserted through the connecting hole 24 into the inner hole 25. The annular stop edge 381 of the pivoting end 38 leans against the outer end of the connecting hole 24 to position the connecting rod 32 quickly. The driving section 39 of the connecting rod 32 is engaged in the connecting hole 24. The second O-ring 42 is compressed and forced into the connecting hole 24, so that the connecting rod 32 is positioned stably. Then, the rotating handle 31 is turned about the axle 43 in the pivoting slot 382 in a direction facing away from the stop wall 384 (as shown in FIG. 6). Preferably, the rotating handle 31 and the connecting rod 32 may be perpendicular to each other, that is, the rotating handle 31 can be turned to rotate the shaft 20, so that the threaded section 21 of the shaft 20 can be screwed to or unscrewed from a fork. Furthermore, the pivoting slot 382 has the stop wall 384 to increase the strength of endurance. In other words, the stop wall 384 is configured to strengthen the pivoting slot 382. It is worth mentioning that the connecting rod 32 is additionally provided with the tool head 40 that can be used for screwing other parts 44 (as shown in FIG. 7) to achieve an additional auxiliary tool.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick-release structure, comprising a shaft, an outer circumferential surface of one end of the shaft having a first threaded section, another end of the shaft having a round shaft head and a connecting hole, an outer end of the first threaded section being formed with a receiving hole that is recessed inwardly;

a driving assembly including:

a rotating handle being in form of a rod one end of the rotating handle being provided with an end cap, another end of the rotating handle having a connecting end;

a connecting rod, being in the form of a rod, including a pivoting end and a driving section that are arranged in sequence from one end thereof, the driving section having a shape corresponding to that of the connecting hole of the shaft, the rotating handle being pivotally connected to the connecting rod, the connecting end of the rotating handle being pivotally connected to the pivoting end of the connecting rod so that the rotating handle is able to be provided relative to one side of the connecting rod;

a first O-ring being sleeved on the rotating handle; and a second O-ring being provided between the pivoting end and the driving section;

wherein when in use, the driving section is engaged in the connecting hole, and the rotating handle can be turned to drive the shaft to rotate; when not in use, the driving assembly is inserted into the receiving hole, the first O-ring and the second O-ring are against an inner circumferential surface of the receiving hole, and the end cap is pressed against an outer end of the receiving hole to be positioned.

2. The quick-release structure as claimed in claim 1, wherein the connecting end has a lateral through hole and the pivoting end has a pivoting slot and a lateral perforation communicating with the pivoting slot, wherein the connecting end of the rotating handle is assembled to the pivoting slot of the connecting rod, and an axle is inserted through the lateral through hole and the lateral perforation for connecting the rotating handle and the connecting rod.

3. The quick-release structure as claimed in claim 2, wherein one side of the pivoting slot is provided with a stop wall.

4. The quick-release structure as claimed in claim 1, wherein the rotating handle is able to pivot 90 degrees relative to the side of the connecting rod.

5. The quick-release structure as claimed in claim 1, wherein the driving section is a polygonal rod, and the connecting hole is a polygonal hole.

6. The quick-release structure as claimed in claim 1, wherein a first annular groove is formed on the rotating handle, and the first O-ring is sleeved on the first annular ring groove, wherein a second annular groove is formed between the pivoting end and the driving section, and the second O-ring is sleeved on the second annular groove.

7. The quick-release structure as claimed in claim 6, wherein the first annular groove is close to the end cap.

8. The quick-release structure as claimed in claim 1, wherein the driving section has an outer diameter less than that of the pivoting end so that one end of the pivoting end forms an annular stop edge facing the driving section, and the annular stop edge is configured to lean against an outer end of the connecting hole when the driving section is engaged in the connecting hole.

9. The quick-release structure as claimed in claim 1, wherein the shaft has an inner hole extending from the connecting hole, the connecting rod further includes a tool head extending from the driving section, and the tool head is located in the inner hole.

10. The quick-release structure as claimed in claim 9, wherein the tool head has an outer diameter less than that of the driving section.

* * * * *